United States Patent [19]

Hausberg et al.

[11] 4,093,434

[45] June 6, 1978

[54] GAS-SCRUBBER APPARATUS FOR BLAST FURNACE

[75] Inventors: Gerhard Hausberg, Essen-Bredeney; Karl-Rudolf Hegemann, Essen-Bergerhausen; Günther Finger, Wesel; Hans Schäfer, Gelsenkirchen; Helmut Weissert, Hamm, all of Germany

[73] Assignee: Gottfried Bischoff Bau Kompl. Gasreinigungs- und Wasserruckkuhlanlagen Kommanditgesellschaft, Essen, Germany

[21] Appl. No.: 670,542

[22] Filed: Mar. 25, 1976

[30] Foreign Application Priority Data

Mar. 26, 1975 Germany ..... 2513360
Aug. 16, 1975 Germany ..... 2536534

[51] Int. Cl.[2] ..... B01D 47/00

[52] U.S. Cl. ..... 55/226; 55/238; 261/DIG. 54; 261/62

[58] Field of Search ..... 55/226, 238, 240, 241; 261/DIG. 54, 62

[56] References Cited

U.S. PATENT DOCUMENTS

| | | | |
|---|---|---|---|
| 3,767,174 | 10/1973 | Heeney | 261/62 |
| 3,844,744 | 10/1974 | Hausberg et al. | 261/DIG. 54 |

FOREIGN PATENT DOCUMENTS

| | | | |
|---|---|---|---|
| 39,600 | 8/1967 | Japan | 261/DIG. 54 |
| 717,884 | 11/1954 | United Kingdom | 261/DIG. 54 |

*Primary Examiner*—Bernard Nozick
*Attorney, Agent, or Firm*—Karl F. Ross

[57] ABSTRACT

The gas-cleaning apparatus for a blast furnace operating under pressure using a differential-pressure washing arrangement whereby the differential-pressure washer comprises at least one annular gap with an annular-gap passage and an axially adjustable body received in the annular gap washer. The nozzle is disposed upstream of the annular-gap washer to spray the washing liquid into the gas which is accelerated through the annular gap. The position of this body is controlled in response to the gas pressure within the head of the blast furnace. The annular gap of the washer diverges in the direction of flow of the gas and the body has a complementary shape so that the gap width remains generally constant although its flow cross section increases with the diameter of the annular gap in the direction of flow of the gas.

6 Claims, 5 Drawing Figures

GAS-SCRUBBER APPARATUS FOR BLAST FURNACE

CROSS-REFERENCE TO RELATED APPLICATION

The present application is related to the commonly owned application Ser. No. 551,052 filed 19 Feb. 1975 (U.S. Pat. No. 3,976,454 issued 24 Aug. 1976) and to the earlier systems described in U.S. Pat. Nos. 3,726,085, 3,855,744, 3,844,745 and 3,854,908.

FIELD OF THE INVENTION

The present invention relates to a gas-cleaning apparatus for high-pressure blast furnaces using differential-pressure washing arrangements and, more particularly, to improvements in annular-gap differential-pressure washers for the scrubbing of a gas with a washing liquid.

BACKGROUND OF THE INVENTION

In the aforementioned earlier work and generally in the art of scrubbing a furnace exhaust gas with a washing liquid, it is known to use a differential-pressure washer which comprises at least one annular-gap washer. An annular-gap washer, as this term is generally used herein, is a duct through which the gas to be scrubbed is passed and provided with a central body which defines an annular gap or annular constriction with a wall of the duct. A pressure differential is generated across this constriction and accelerates the gas threthrough. Water or another washing liquid is sprayed into the gas upstream of the gap so that the water droplets intimately contact the gas as the mixture traverses the annular gap.

In gas cleaning for metallurgical furnaces, the blast furnace is connected at its top with a differential pressure washer comprising at least one gas-conducting duct in which the annular-gap washer is provided. The annular-gap washer comprises the annular-gap canal and the axially shiftable insert body defining the annular gap in the latter. The washing agent is, as noted, sprayed into the gas stream upstream of the insert body, with reference to the direction of gas flow, and this body can be, as described in the aforementioned patents, connected in a control circuit for regulating the pressure of the exhaust gas at the gas outlet of the blast furnace. A pressure sensor may respond to the pressure within the blast furnace and can be connected in a control circuit for the servomechanism displacing the insert body to increase or decrease the gap width as required.

For the purposes of the present description, the term "annular-gap passage" will be used to describe not the entire duct of the annular-gap washer but only that portion of the duct which is directly juxtaposed with a surface of the insert body to define a constriction therewith. In general the annular-gap washer has an inlet whose diameter corresponds to the diameter of the duct head of the annular gap and an outlet whose diameter can be less than that of the duct.

In conventional blast furnace gas cleaning installations using annular-gap washers of the aforedescribed type, the following phases of gas cleaning operation can be discerned:

a transfer of the particles in the dust-containing gas to the surface of the liquid droplets or film of the washing liquid;

a removal of the particles by their entrainment with the liquid; and the collection of the liquid with the dust particles from the dust removal apparatus.

In general, these steps for the scrubbing of a gas do not differ in the first phase from other types of scrubbers. Removal of the dust particles by the transfer to the liquid, however, is characteristic of the annular-gap washer since effective dust removal takes place only with high input speeds of the gas. It appears that the usual annular-gap washer operates in part by the venturi principle. It utilizes the fact that in a venturi nozzle, a pressure differential across a constriction is converted into a velocity increase and hence extremely high velocities can be developed within the annular-gap.

The highest velocities develop at the throat of the classical venturi scrubber so that the liquid is dispersed. Gas velocities of 20 to 120 meters/per second and more can be attained and the overall dust removal can exceed 99%.

Accordingly the conventional annular-gap washer converges in the direction of gas flow and the surfaces of the insert body has a corresponding convergence so that the diameter of the annular gap decreases in the direction of gas flow although the width (radial dimension) of the gap may remain constant between the inlet and the outlet sides of the annular-gap washer. Since the dust particles present in the hot gas can act as nuclei for condensation, the gas volume traversing the annular-gap decreases as condensation proceeds between the inlet and outlet sides of the annular gap.

Another advantage of the conventional annular-gap washer is that it can be used to control the pressure in the head of the blast furnace. In other words the inserted body can function as an adjustment element for regulating the pressure of the exhaust gas at the head of the furnace with the aid of the aforementioned control circuit.

In gas cleaning apparatus for a high pressure blast furnace in which the exhaust gas is originally at a pressure of about 3 atmospheres gauge, it is generally desirable to reduce the pressure in the annular gap washer to 1.2 or 1.1 atmospheres gauge while processing large quantities of gas.

The problems with such systems have generally centered on corrosion and erosion of the apparatus resulting from the high velocities and high volumetric rates of flow of the gas and can only be solved, with limited success, by using special corrosion resisting materials.

In practice, moreover, it has been found that several annular-gap washing stages may be necessary for the desired degrees of pressure reduction in the annular-gap washer. Furthermore the pressure reduction may require a prewashing or prescrubbing step for coarse separation of the dust, an adjustable differential pressure washer, and a droplet separator with a clean-gas takeoff in succession along the duct leading from the blast furnace. The differential pressure washer may be the exclusive unit for controlling the pressure in the blast furnace by the control circuit connected to its shiftable insert body and the differential pressure washer itself may comprise two annular-gap washers, the first serving for the control of the pressure and the second being connected to an expansion turbine. The two annular-gap washers are disposed one behind the other and are provided with a bypass duct which is branched behind the annular-gap washer, in the direction of gas flow, to the pure gas takeoff. The bypass duct can be provided with a control valve and the expansion turbine. The arrangement improves the ability to control the pressure in the gas furnace and insures the desired level of pressure drop in the gas derived therefrom.

OBJECTS OF THE INVENTION

It is the principal object of the present invention to provide a gas cleaning device for a high pressure blast furnace which has a wide range of controllability so as to enable the pressure to be dropped therein from a level of 3 atmospheres gauge or more to about 1.2 to 1.1 atmospheres gauge in a single unit.

It is another object of the invention to provide an annular-gap washer which improves upon the overall performance of the prior art system described above and eliminates at least some of the disadvantages of these earlier systems.

Still another object of the invention is to provide an improved annular-gap washer capable of high gas throughput and high dust-removal efficiency with a wide range of pressure drop.

SUMMARY OF THE INVENTION

These objects and other which will become apparent hereinafter are attained, in accordance with the present invention, in an annular-gap washer adapted to be built into the duct leading from the gas takeoff of a high pressure blast furnace and which comprises an annular-gap passage which widens progressively in the direction of flow of the gas and has an insert body which correspondingly and complementarily widens or diverges in the direction of flow of the gas to define with the wall of the passage a corresponding annular gap of increasing diameter and cross section but generally of constant radial width.

Preferably the insert body is axially shiftable relative to the passage to control the radial width of the annular-gap and at the same time the length thereof. In other words, the insert body and the wall of the annular-gap passage have juxtaposed regions of an axial length which may exceed the diameter of the annular gap at its gas-entry end and thus the axial displacement of the insert body can simultaneously adjust the effective length of the annular gap in the flow direction. The insert body can, therefore, be inserted to a greater degree into the annular-gap passage or can be withdrawn somewhat therefrom in adjusting the effective length as noted.

Most advantageously the annular-gap washer of the present invention has an annular-gap passage of control cross section and the insert body is likewise of circular cross section. The divergence of the annular-gas passage can be frustoconical and the insert body can be a frustoconic having the same apex angle as the frustoconical wall of the passage. The dimensions of the passage and the insert body can be varied widely in accordance with the requirements of the high pressure blast furnace without detracting from the effectiveness of the system of the present invention. It has been found to be desirable, for optimum operation of the device, when the divergence of the annular-gap passage is so selected that the exhaust gas flow in the annular-gap has a substantially linearly increasing pressure drop. The pressure drop is preferably so selected that the exhaust gas velocity at the outlet end of the annular-gap more or less corresponds to the inlet velocity. However, the outlet gas velocity can also be greater or less than the inlet gas velocity as may be necessary in any particular case.

The system of the present invention breaks with the traditional concept of the configuration of an annular-gap washer for a blast-furnace gas cleaning apparatus. As has been noted above, conventional teachings rely upon the ventury principle and generate an acceleration of the gas velocity based upon the venturi principle. However, the enlargement of the annular-gap passage, which is critical to the present invention, is contrary to the venturi principle and operates by decelerating exhaust gas over the length of the annular-gap passage.

The pressure drop of the system of the present invention can be substantially greater than that of a classical annular-gap washer, operating under the venturi principle, thereby increasing the range of pressure drops which can be controlled by the present system. The increase in the operating range of the system of the present invention allows the washer to be provided downstream of a high pressure blast furnace and, in a single cleaning stage, to drop pressures of 3 or more atmospheres gauge to a level of 1.2 or 1.1 atmospheres gauge by expansion.

While the venturi principle under which the annular gap washer of prevailing technology operating has been relinquished in the system of the present invention, there is nevertheless a surprisingly effective cleaning with an extremely high of dust removal. In practice it has been found that the system of the invention is not poorer with respect to the degree of dust removal than the conventional device but allows control of the pressure drop within a much greater range.

SPECIFIC DESCRIPTION

The above and other objects, features and advantages of the present invention will become more readily apparent from the following description, reference being made to the accompanying drawing in which.

DETAILED DESCRIPTION

Figure 1:
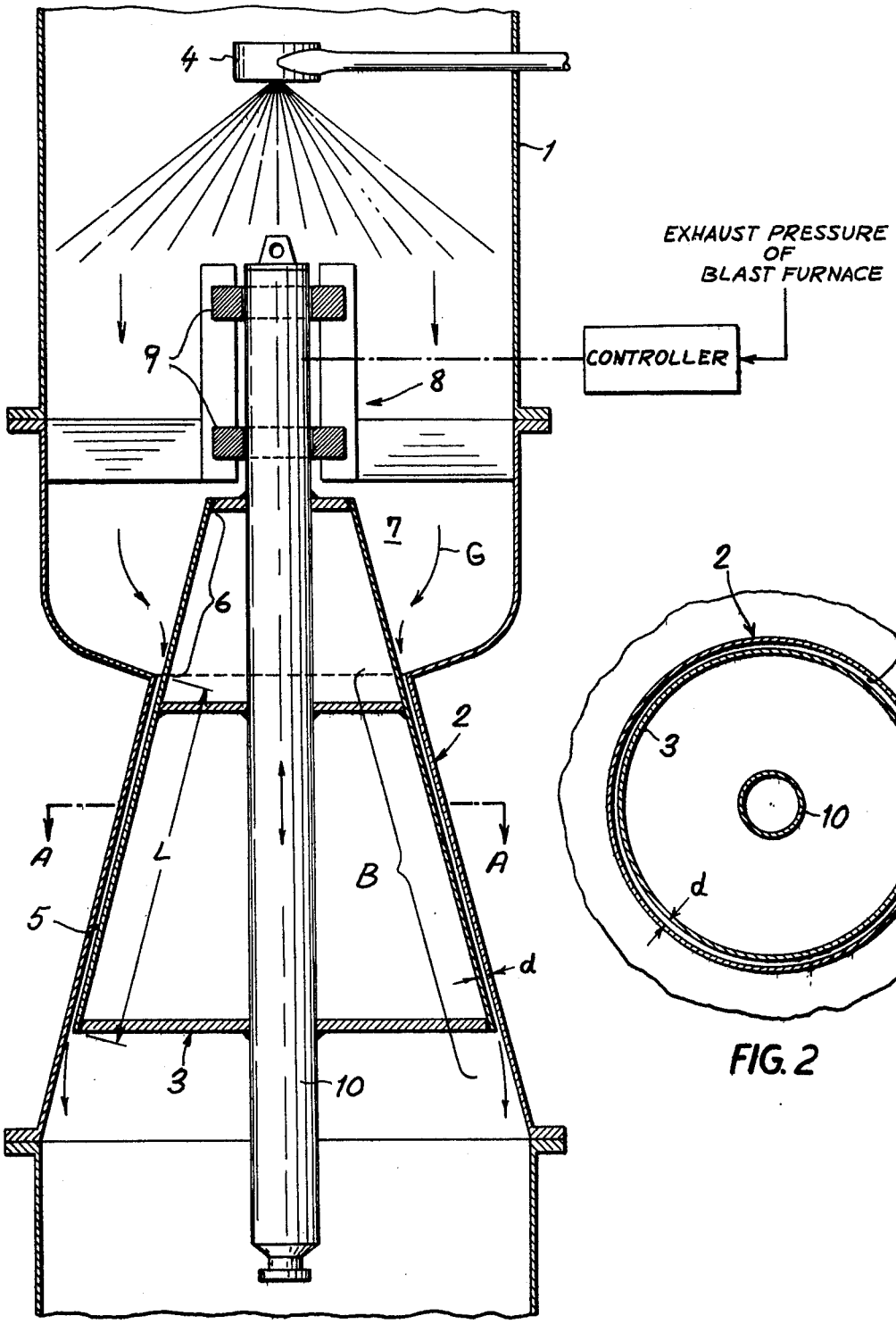
FIG. 1 is a somewhat diagrammatic axial cross sectional view through a gas cleaning apparatus for a high pressure blast furnace.

The annular-gap washer illustrated in the drawing is intended to be used in a blast-furnace gas-cleaning plant for a high-pressure blast furnace as described, for example, in the aforementioned patents, the annular-gap washer being of the differential-pressure scrubber type.

The differential pressure washer, disposed in a duct 1 leading from the waste-gas takeoff point of the blast furnace, is formed with an annular-gap passage 2 which diverges axially in the direction of gas flow as shown by the arrows. An axially shiftable insert body 3 is disposed in the annular-gap passage 2 and above this body and upstream with respect to the flow direction, there is provided a nozzle 4 for spraying washing liquid toward the annular-gap 5 defined between the body 3 and the wall of the passage 2. The washing liquid is generally water although basic or alkaline materials can be added to remove acid components of the gas. The annular-gap washer, as represented in FIG. 1, is the control element of a control system having an input from the high-pressure blast furnace.

The annular-gap passage 2 progressively diverges frustoconically in the direction of flow of the gas and the insert body 3 is similarly frustoconical so that the annular-gap 5 is of constant radial width *d* over substantially its entire length L. The overall length of body 3 can be equal to or greater than that of the frustoconical portion 2 of the annular-gap washer so that a region 6 of the insert body 3 projects axially out of the mouth of the passage 2 and enables the body 3 to be shifted by a corresponding length to increase the effective length L of the passage 5 to an equivalent degree. The effective length of the annular-gap 5 is best seen in FIG. 3 which also includes a graph representing the pressure drop as a function of the length L.

Figure 2:
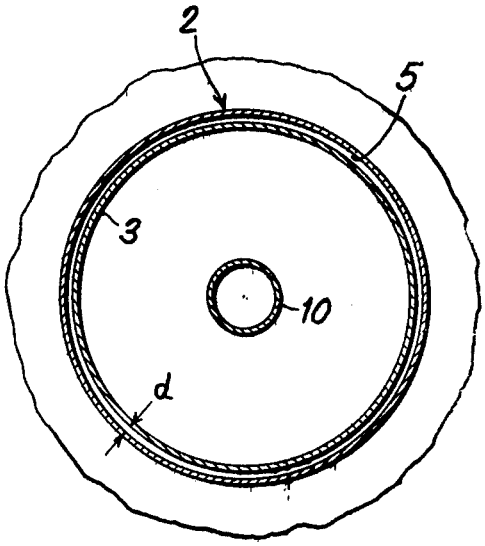
FIG. 2 is a cross section taken along the line A — A of FIG. 1.
Figure 3:
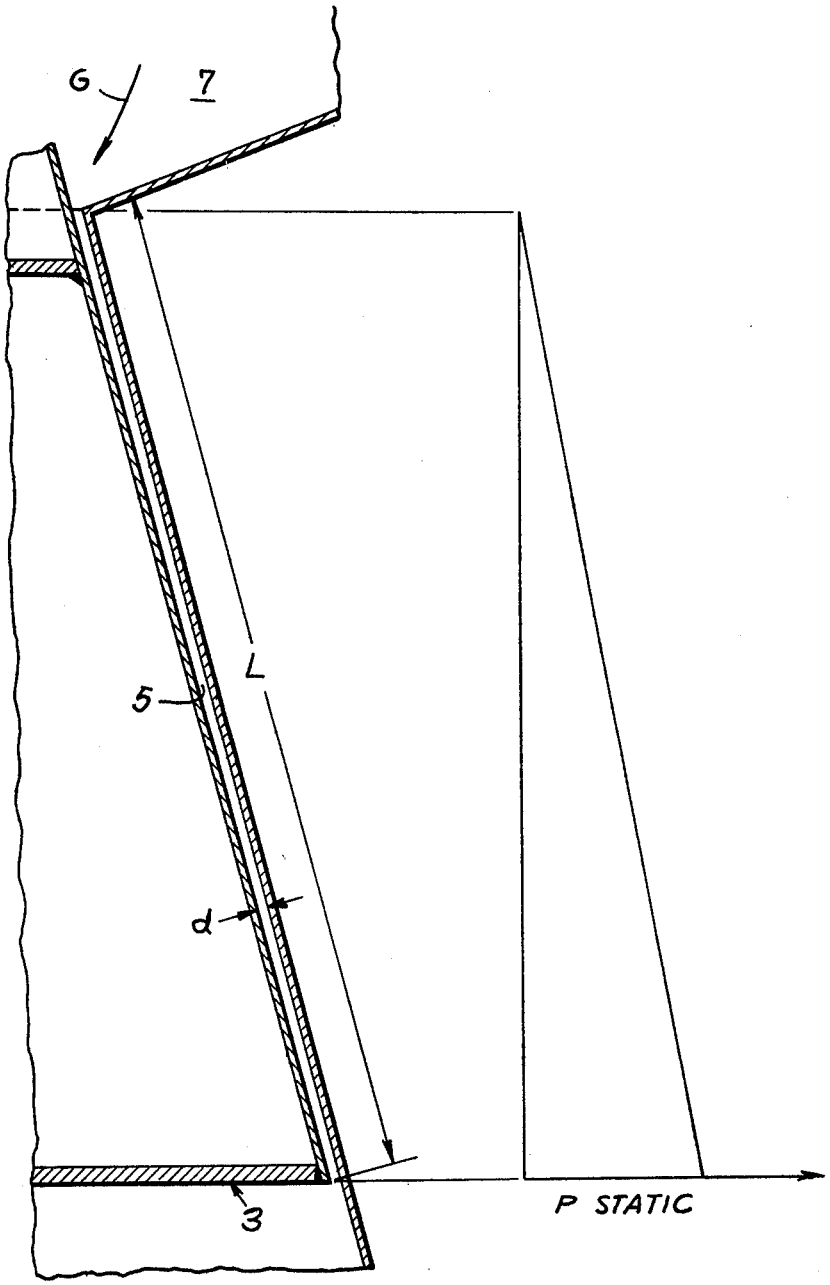
FIG. 3 is a detail view of the region represented at B in FIG. 1, illustrating the pressure drop portion of the annular-gap.

In the embodiment of FIGS. 1 through 3, the passage 2 and the body 3 have circular cross sections and hence are both frustocones with identical apex angles. While this configuration is preferred, it is not, however, necessary. Furthermore, while it is preferred to operate with a constant radial thickness *d* over the length L of the annular-gap, this thickness or gap width can be reduced progressively in the direction of flow G of the gas stream. In any event it is desirable that the device be dimensioned so that the pressure drop over the length L is substantially linear and that the gas velocity leaving the gap 5 is more or less equal to the gas velocity upon entry thereof.

By way of example and preferably, the length L should be at least two times greater than the diameter of the passage 2 at the inlet end. The duct 1 has a diameter which should be equal to that of the passage 2. The duct 1 can be provided with a collecting chamber 7 which forms the transition between the large diameter duct 1 of the small diameter mouth of the passage 2. The extension 6 of the body 3 can project into the chamber 7.

The confronting surfaces of the body 3 and the passage 2 are roughened to increase the intimacy of gas-liquid contact. A bearing 9, slidably receiving the stem 10 carrying the body 3 and forming part of a support structure by which the body 3 is mounted for axial movement within the washer. When the mounting means includes radially extending arms as shown, these can be formed as guide vanes which impart a rotary movement to the gas about the axis of the washer. The body 3 can also be rotated, if desired, for example by the flowing gas itself, in which case vanes are provided upon the body 3 to rotate the same in the manner of a gas turbine or propeller. The relative rotation of the gas and one or both of the walls of an annular-gap washer further increases the pressure drop by drag.

Figure 4:
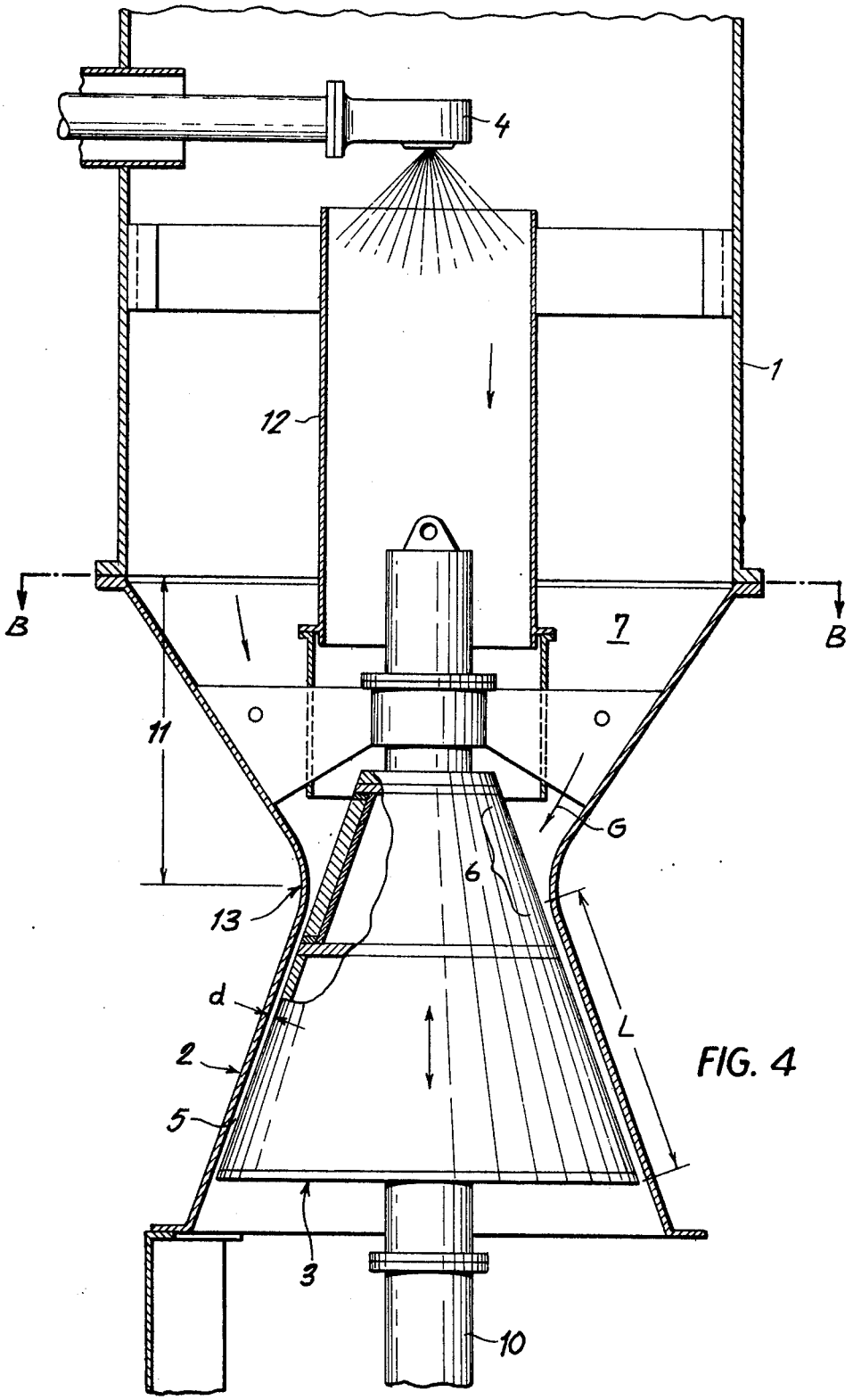
FIG. 4 is a view similar to FIG. 1 illustrating another embodiment of the invention.
Figure 5:
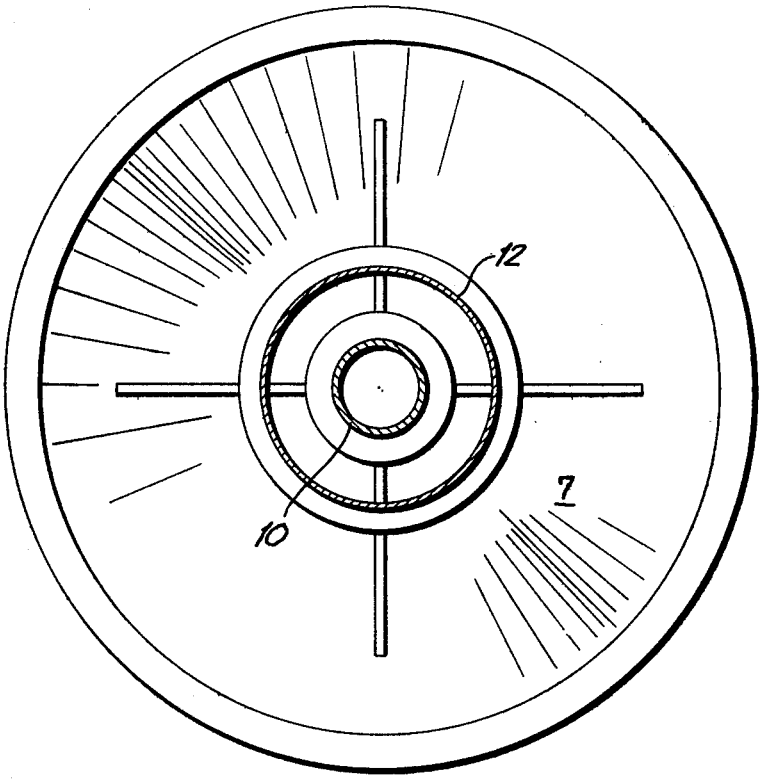
FIG. 5 is a section taken along the line B — B of FIG. 4.

The embodiment of FIGS. 4 and 5 has been found to be especially effective both with respect to cleaning and permitting a large range of pressure drops and even with respect to the quantity of water which can be effectively used per unit volume of the exhaust gas. In this case, the duct 1 is provided with a venturi nozzle section 11 which communicates with the annular-gap passage 2 which constricts the diameter of the duct to the smallest diameter (inlet diameter) of the passage 2. The venturi section 11 is located ahead of and coaxial with the frustoconical body 3 and is formed with a tube 12 into which the spray of the washing agent is discharged from the nozzle 4. The transition between the venturi nozzle 11 and the annular-gap passage 2 is a continuous curve as seen in axial section.

The tube 12 has a diameter which corresponds to the smallest diameter of the annular gap 5 (the internal diameter at region 13).

Additional nozzles 4 can discharge the washing agent into the space surrounding the tube 12. Surprisingly, the venturi section does not detrimentally effect the previously described results of the progressively widening annular gap 5 although it has been found that it does promote the particle interchange between the gas G and the washing water.

We claim

1. A gas-cleaning apparatus for a high-pressure blast furnace comprising a cylindrical duct leading from the blast furnace, and an annular-gap washer connected to said duct, said annular-gap washer comprising:

wall means below said duct forming a frustoconical passage diverging progressively in the direction of gas flow;

a frustoconical insert body of complementary divergence received in said passage and defining with said wall means an annular gap of progressively increasing diameter from an inlet side of of said gap to an outlet side thereof:

means in said passage mounting said body for axial shifting relative to said wall means to adjust the radial width of said gap and control the pressure drop across the annular-gap washer, said body having the same conicity as said passage between said inlet and outlet sides;

nozzle means in said duct above said wall means and said body for spraying and scrubbing liquid into the gas entering the inlet side of said gap, said passage having a diameter at said outlet side corresponding to the diameter of said duct; and a collecting chamber between said duct and said wall means, said chamber having an upper diameter equal to that of said duct and a lower diameter equal to that of said inlet side while forming a generally horizontal bottom on the level of said inlet side, said body having a projecting portion reaching into said chamber and engaging said mounting means for the axial shifting of said body, said collecting chamber having a wall connected to said duct and to said wall means, said gap being so dimensioned that the pressure drop along the length of said gap is substantially linear and the gas exits from said outlet side at substantially the same velocity as that with which it enters said inlet side.

2. The gas-cleaning apparatus defined in claim 1 wherein said gap has a length substantially equal to twice the diameter of said gap at said inlet side.

3. The gas-cleaning apparatus in claim 1 wherein said body and said wall means have confronting roughened surfaces.

4. The gas-cleaning apparatus defined in claim 1, further comprising guide means in said duct above said chamber for mounting said body for axial movement in said passage, said guide means being provided with radial vanes imparting a rotary component of movement to the gas entering said inlet side.

5. The gas-cleaning apparatus defined in claim 1, further comprising guide means in said duct above said chamber for imparting a rotary movement to the gas entering said inlet side.

6. The gas-cleaning apparatus defined in claim 1, further comprising means enabling rotation of said body relative to said wall means.

* * * * *